US008726868B2

(12) United States Patent
Suchecki

(10) Patent No.: US 8,726,868 B2
(45) Date of Patent: May 20, 2014

(54) ENGINE DRIVE SYSTEM

(75) Inventor: Tom Suchecki, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 174 days.

(21) Appl. No.: 13/351,070

(22) Filed: Jan. 16, 2012

(65) Prior Publication Data

US 2013/0180487 A1 Jul. 18, 2013

(51) Int. Cl.

| | |
|---|---|
| ***F01L 1/02*** | (2006.01) |
| *F01L 1/053* | (2006.01) |
| *F01L 1/047* | (2006.01) |

(52) U.S. Cl.

CPC ..... *F01L 1/026* (2013.01); *F01L 1/053* (2013.01); *F01L 1/047* (2013.01)

USPC ..... 123/90.31; 123/90.16; 123/90.27

(58) Field of Classification Search

USPC ..... 123/90.27, 90.16, 90.31

See application file for complete search history.

(56) References Cited

U.S. PATENT DOCUMENTS

| | | | | |
|---|---|---|---|---|
| 5,178,108 | A | 1/1993 | Beaber | |
| 5,181,485 | A | 1/1993 | Hirose et al. | |
| 5,351,663 | A | 10/1994 | Makimura et al. | |
| 5,471,895 | A | 12/1995 | Ohmon et al. | |
| 5,579,664 | A | 12/1996 | Ohmon et al. | |
| 5,931,127 | A * | 8/1999 | Buck et al. | 123/90.17 |
| 6,652,400 | B2 | 11/2003 | Duesmann et al. | |
| 6,877,467 | B2 | 4/2005 | Katayama | |
| 6,976,476 | B1 * | 12/2005 | Mantri | 123/508 |
| 7,219,635 | B2 * | 5/2007 | Watabe et al. | 123/90.15 |
| 7,534,181 | B2 | 5/2009 | Perissinotto | |
| 2004/0206323 | A1 | 10/2004 | Shintani | |
| 2006/0135303 | A1 | 6/2006 | Perissinotto | |

FOREIGN PATENT DOCUMENTS

| | | | |
|---|---|---|---|
| DE | 3347638 | A1 | 7/1985 |
| EP | 1452698 | A1 | 9/2004 |
| JP | 57210109 | A | 12/1982 |

* cited by examiner

*Primary Examiner* — Ching Chang

(74) *Attorney, Agent, or Firm* — Julia Voutyras; Alleman Hall McCoy Russell & Tuttle LLP

(57) ABSTRACT

A system for an engine drive that engages a timing band with a first camshaft, a driveshaft and a crankshaft is provided. The system further includes a gear drive including a first gear coupled to the driveshaft and a second gear coupled to a second camshaft. The second camshaft is positioned between the first camshaft and the driveshaft such that the shafts are horizontally coplanar.

20 Claims, 2 Drawing Sheets

ENGINE DRIVE SYSTEM

BACKGROUND AND SUMMARY

Vehicles may use an engine drive system to drive various features in an internal combustion engine. For example, a typical engine drive system for a dual overhead camshaft arrangement includes a timing belt that engages various sprockets to rotate both camshafts and a crankshaft.

For example, U.S. Pat. No. 5,351,663 describes a torque transmission mechanism including a plurality of camshaft gears. The camshaft gears include multiple layers or interfaces with teeth for engaging with the teeth of another gear.

The inventors herein have recognized various issues with the above system. In particular, overlapping sprockets to couple a camshaft to the engine drive system increases wear of the overlapping sprockets due to the multiple interacting surfaces. Further, such overlapping sprockets are not durable to withstand high engine loads.

As such, one example approach to address the above issues is to indirectly couple a camshaft to the engine drive system via a meshed gear drive. In this way, it is possible to reduce the spacing between the camshafts, without overlapping sprockets.

Specifically, in one embodiment, an exhaust camshaft is directly rotatably coupled to the engine drive system and the intake camshaft is indirectly rotatably coupled to the engine drive system via a meshed gear drive. The meshed gear drive includes a first gear coupled to a sprocket of the engine drive system via a driveshaft. Further, the first gear is matingly coupled with a second gear to drive a rotation of the intake camshaft. This configuration enables the intake camshaft to be positioned between the exhaust camshaft and the driveshaft such that the shafts are horizontally coplanar. In this way, it is possible to reduce the spacing between the camshafts without the use of overlapping sprockets.

Note that various bands may be used, such as timing chain, a timing belt, or various other types of elastic and/or inelastic flexible bands. Further, the band may mate to toothed or un-toothed pulleys on the various shafts. Further still, additional bands may also be used, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to an engine drive system that is directly rotatably coupled to a first camshaft and indirectly rotatably coupled to a second camshaft via a meshed gear drive. This arrangement allows a spacing between the first and second camshafts to be reduced, without overlapping sprockets. By reducing the spacing between the camshafts, a valve angle with a cylinder head port can be improved. Further, this configuration allows for improved variable cam timing mechanisms since the camshafts are independently actuated through different systems. Further still, this engine drive system allows for a more compact design with a lower engine weight than traditional designs due to the resulting geometric configuration. Moreover, an engine compression ratio may be increased due to the resulting geometric configuration, if desired.

Various accessory drives may be included in the disclosed engine drive system. For example, an oil pump and a balance shaft may be driven by the disclosed engine drive system, if desired. Additionally, the engine drive system may include various pulleys, idlers and tensioning devices to further ensure a reflex wrap angle, if desired.

Figure 1:
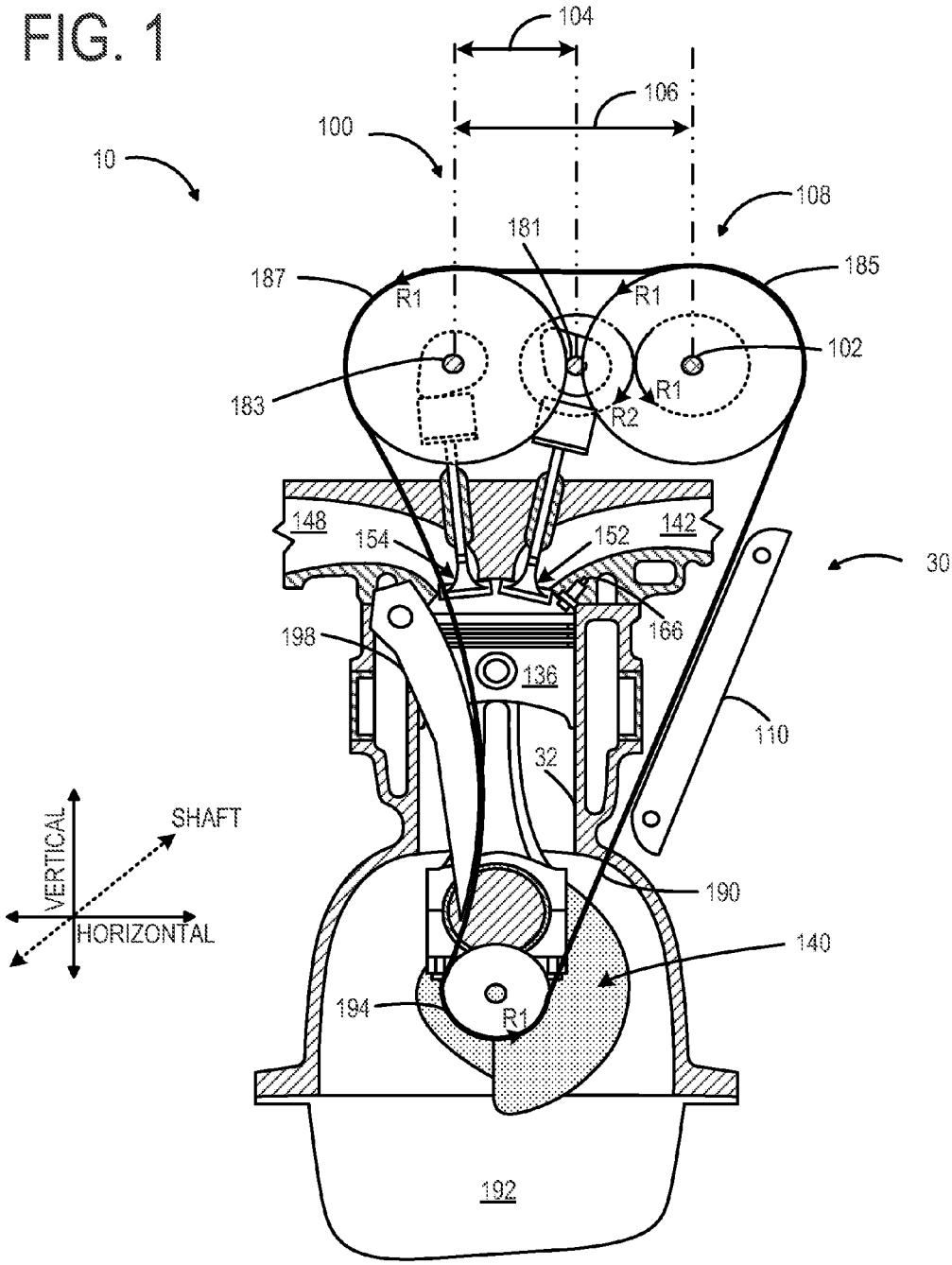
FIG. 1 schematically shows an example engine including an example engine drive system, according to an embodiment of the present disclosure.

FIG. 1 shows a schematic diagram of an example engine 10 showing one cylinder of a multi-cylinder inline engine.

Combustion cylinder 30 of a multi-cylinder engine may include combustion cylinder walls 32 with piston 136 positioned therein. Piston 136 may be coupled to crankshaft 140 so that reciprocating motion of the piston is translated into rotational motion of the crankshaft. Crankshaft 140 may be coupled to crankshaft sprocket 194 and crankshaft 140 may also be coupled to at least one drive wheel of a vehicle via an intermediate transmission system (not shown). Further, a starter motor (not shown) may be coupled to crankshaft 140 via a flywheel to enable a starting operation of the multi-cylinder engine. Crankshaft 140 may be lubricated with oil contained within oil sump 192.

Combustion cylinder 30 may receive air via intake passage 142 and may exhaust combustion gases via exhaust passage 148. Intake passage 142 and exhaust passage 148 may selectively communicate with combustion cylinder 30 via respective intake valve 152 and exhaust valve 154. In some embodiments, combustion cylinder 30 may include two or more intake valves and/or two or more exhaust valves.

In this example, intake valve 152 and exhaust valve 154 may be stimulated by camshafts 181 and 183 respectively, shown here as including camshaft lobes. Intake valve 152 and exhaust valve 154 may be further controlled by one or more cam actuation systems (not shown) which may each include one or more cams and may utilize one or more of cam profile switching (CPS), variable cam timing (VCT), variable valve timing (VVT) and/or variable valve lift (VVL) systems that may be operated by a controller to vary valve operation. The position of intake valve 152 and exhaust valve 154 may be determined by position sensors and intake valve 152 and/or exhaust valve 154 may be controlled by electric valve actuation.

Fuel injector 166 is shown coupled directly to combustion cylinder 30 for injecting fuel directly therein in proportion to the pulse width of signal FPW received from a controller. In this manner, fuel injector 166 provides what is known as direct injection of fuel into combustion cylinder 30. The fuel injector may be mounted on the side of the combustion cylinder or in the top of the combustion cylinder, for example. Fuel may be delivered to fuel injector 166 by a fuel delivery system (not shown) including a fuel tank, a fuel pump, and a fuel rail. In some embodiments, combustion cylinder 30 may alternatively or additionally include a fuel injector arranged in intake passage 142 in a configuration that provides what is known as port injection of fuel into the intake port upstream of combustion cylinder 30.

The engine drive system 100, as shown in FIG. 1, uses a band 190 to synchronize various rotating parts. Band 190 may be a timing belt or timing chain, and may be formed as a single continuous band that follows a serpentine path. Band 190 may be a timing belt such as a V-belt or a V-ribbed belt, or band 190 may be a timing chain. Band 190 may have chain links coupled to each other with pins or band 190 may otherwise have chain elements with holes that engage with sprocket teeth. Alternatively, band 190 may be a rubber belt without holes. According to one embodiment, band 190 may engage and couple one camshaft, a driveshaft and a crankshaft via various devices such as sprockets. Further, the band 190 may engage and couple various additional accessory devices via devices such as sprockets. Moreover, band 190 may engage additional devices such as pulleys and/or idlers.

In one example, band 190 may engage toothed sprockets, where holes in the band align with the teeth of the sprocket. In another example, band 190 may contact a device without teeth such that a surface of the band may be in contact with a surface of the device, where the surface of the device may include a groove. Band 190 may contact each device with a wrap angle, which for one or more devices is a reflex wrap angle. Here, the wrap angle corresponds to an arc length of contact between the band 190 and the various sprockets, pulleys, etc. and a reflex wrap angle may be 180 degrees or more, but less than 360 degrees. Additionally, band 190 may engage some devices with a wrap angle that is smaller than a reflex wrap angle.

As shown, band 190 engages a first sprocket 187, a second sprocket 185, and a third sprocket 194 such that each sprocket is rotated in a direction R1. First sprocket 187 may be rotatably coupled to camshaft 183, thus camshaft 183 may be directly driven by engine drive system 100 such that sprocket 187 and camshaft 183 rotate together. Second sprocket 185 may be rotatably coupled to a driveshaft 102, thus driveshaft 102 may be directly driven by engine drive system 100 such that sprocket 185 and driveshaft 102 rotate together. Third sprocket 194 may be rotatably coupled to crankshaft 140, thus crankshaft may be directly driven by engine drive system 100 such that sprocket 194 and crankshaft 140 rotate together. In this way, camshaft 183, driveshaft 102 and crankshaft 140 are drive shafts, directly rotated by the engine drive system. Notably, camshaft 181 is not directly rotatably coupled to engine drive system 100. Rather, in some embodiments, camshaft 181 may be a driven shaft, indirectly rotated by the engine drive system.

As described in more detail below, the engine drive system is arranged in such a way that a spacing 104 between camshaft 181 and camshaft 183 is reduced. For example, spacing 104 may be less than a distance 106 between camshaft 183 and driveshaft 102. As described in more detail below, camshaft 181 may be indirectly rotatably coupled to the engine drive system via a meshed gear drive 108, wherein camshaft 181 is rotated in a direction R2 opposite of direction R1.

Sprockets 185 and 187 are shown with a diameter that is twice the diameter of crankshaft sprocket 194 to provide desired timing of intake valve 152 and exhaust valve 154 during the four-stoke combustion cycle. Alternatively, camshaft sprockets 185 and 187 may be another size, if desired.

Tensioning device 198 is shown engaged with band 190. Tensioning device 198 may employ various pulleys, springs, levers and other adjustment mechanisms to actively adjust the tension of band 190 which may ensure a reflex wrap angle around each sprocket, idler, pulley and the like. However, it will also be appreciated that engine drive system 100 may include sprockets, idlers and pulleys with a smaller wrap angle.

Chain guide 110 is shown engaged with band 190. Chain guide 110 may guide band 190 so as to maintain tension in band 190 in addition or alternative to tensioning device 198. Further, chain guide 110 may include a lubrication mechanism that lubricates band 190 as the band circulates through the engine drive system.

It will be appreciated that the drive system may include additional and/or alternative components than those illustrated in FIG. 1. For example, the engine drive system may include one or more accessory devices that may be coupled to band 190 via a device sprocket. The accessory devices may include one or more of an oil pump, a balance shaft, a water pump, a power steering pump, an air conditioning compressor, a fan, and a fuel pump, which are provided as non-limiting examples.

Further, the engine drive system may include an idling device. For example, the idling device may be a pulley or a sprocket. It will be appreciated that engine drive system 100 may include one or more idling devices and each idling device may engage band 190 with a first contacting side and/or a second, opposite, contacting side.

Further, it is to be appreciated that one or more of the aforementioned accessory drives, tensioning devices, sprockets, pulleys, and/or idlers may engage the first contacting side or the second contacting side of band 190. Thus, it will be appreciated that band 190 is not limited to a path as illustrated in FIG. 1. For example, band 190 may follow a serpentine path to engage various devices at various locations in engine 10.

As described above, FIG. 1 shows only one cylinder of a multi-cylinder engine, and each cylinder may similarly include its own set of intake/exhaust valves, camshafts, crankshafts and accessory devices etc. coupled to the engine drive system 100, or alternatively coupled to another drive system.

Figure 2:
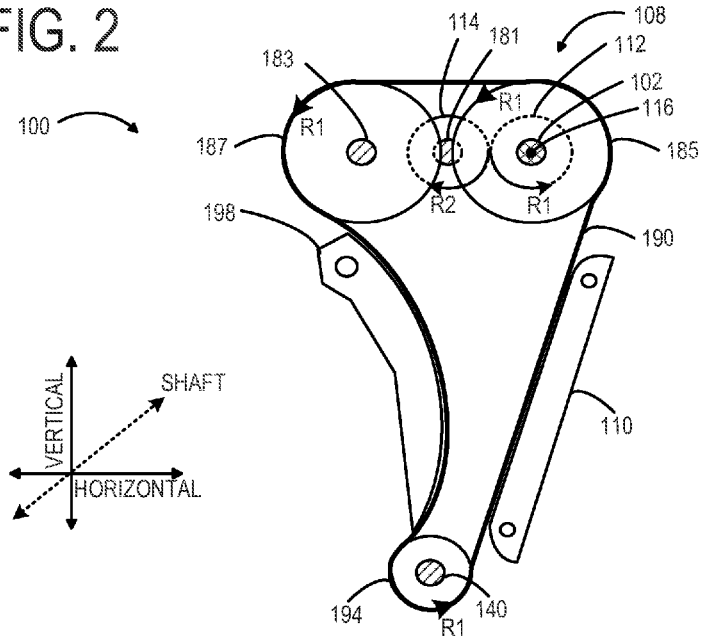
FIG. 2 schematically shows a front perspective view of the engine drive system of FIG. 1.

FIG. 2 schematically shows a front view of engine drive system 100 according to an embodiment of the present disclosure. It will be appreciated that like features are indicated with common reference numbers, and such features will not be discussed repetitively for the sake of brevity. Engine drive system 100 may include band 190 rotatably coupling first sprocket 187, second sprocket 185, and third sprocket 194 as described above.

Further, engine drive system 100 may be coupled to meshed gear drive 108. Mesh gear drive 108 may include a first gear 112 and a second gear 114. The first and second gears may mesh such that the gears rotate in opposite directions. For example, first gear 112 may rotate in the direction R1 whereas second gear 114 may rotate in the direction R2. Further, both the first gear and the second gear may include teeth that matingly fit with each other such that a rotation of first gear 112 drives a rotation of second gear 114. For example, a tooth of the first gear may matingly fit with a space between two consecutive teeth of the second gear. Thus, first gear 112 may be a drive gear and second gear 114 may be a driven gear.

First gear 112 is coupled to driveshaft 102, as shown. Further, first gear 112 may be positioned behind sprocket 185 in a shaft direction. Thus, first gear 112 and sprocket 185 may share a center axis 116 along the shaft direction. As shown, first gear 112 may have a smaller diameter than sprocket 185. In some embodiments, first gear 112 may have another size. For example, first gear 112 may have a similar diameter as compared to sprocket 185, or first gear 112 may have a larger diameter than sprocket 185. Further, first gear 112 may include teeth that matingly couple with teeth of second gear 114.

Second gear 114 is coupled to camshaft 181, as shown. Further, second gear 114 may be positioned behind sprockets 185 and 187 in the shaft direction. As one example, second gear 114 may be positioned behind sprockets 185 and 187 such that second gear is equidistant from first camshaft 183 and driveshaft 102. However, it will be appreciated that second gear 114 may not be equidistant from first camshaft 183 and driveshaft 102, thus second gear 114 be closer to first camshaft 183 or driveshaft 102 in some embodiments. As shown, second gear 114 may have a smaller diameter than sprockets 185 and 187. Further, second gear 114 may have a diameter that is approximately equal to first gear 112. However it will be appreciated that second gear 114 may have another size in some embodiments.

Further, meshed gear drive 108 may be aligned with engine drive system 100 such that camshaft 181, camshaft 183, and driveshaft 102 are horizontally coplanar. In other words, camshaft 181, camshaft 183, and driveshaft 102 may have a similar vertical position such that the three shafts are positioned on the same horizontal plane. For example, a central axis of each of camshaft 181, camshaft 183, and driveshaft 102 may be parallel to each other and horizontally coplanar. Further, by positioning camshaft 181 between camshaft 183 and driveshaft 102, a space 104 between the camshafts can be reduced.

Figure 3:
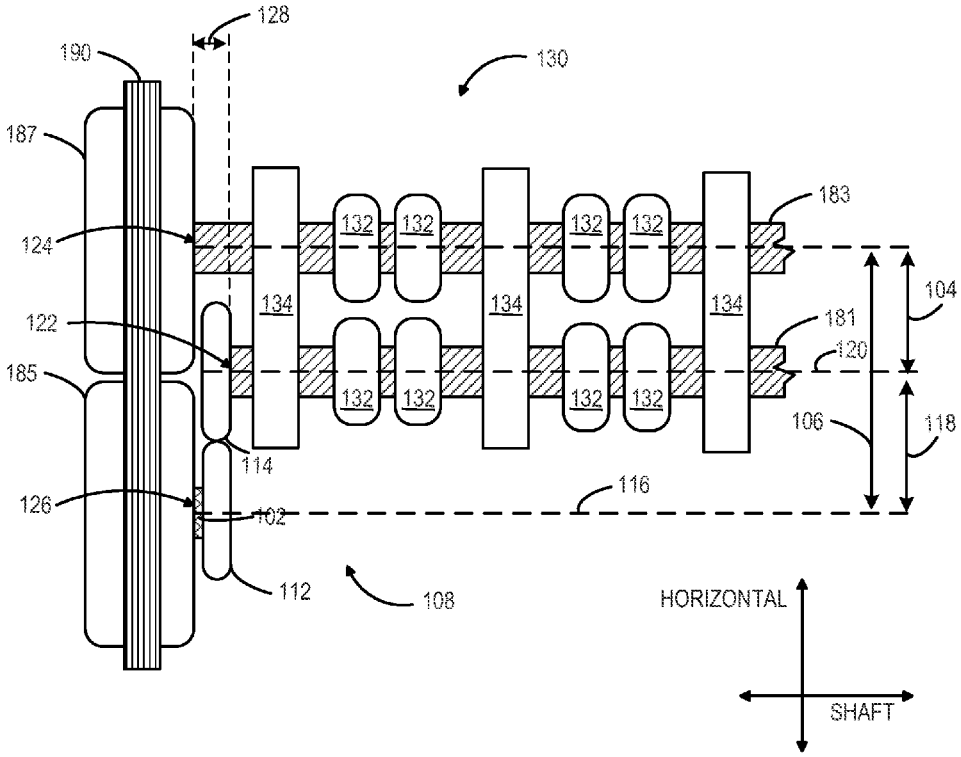
FIG. 3 schematically shows a top perspective view of the engine drive system of FIG. 1.

For example, FIG. 3 schematically shows a top view of engine drive system 100 according to an embodiment of the present disclosure. As shown, spacing 104 between camshaft 181 and camshaft 183 is reduced due to the configuration of the meshed gear drive. Spacing 104 is reduced in comparison to traditional engine drive system arrangements which directly couple both camshafts to the engine drive system. For example, the spacing 104 is reduced by approximately a distance 118 between central axis 116 of driveshaft 102 and a central axis 120 of camshaft 181. In other words, the spacing between the camshafts is smaller than distance 106 between camshaft 183 and driveshaft 102.

Further, camshaft 181 may be offset from camshaft 183 and driveshaft 102, as shown. In other words, an end portion 122 of camshaft 181 may have a different position in the shaft direction from an end portion 124 of camshaft 183 and an end portion 126 of driveshaft 102. In this way, camshaft 181 is offset by a shaft distance 128 from camshaft 183 and driveshaft 102.

FIG. 3 also shows a valve train 130 including a plurality of cam lobes 132. Valve train 130 may be configured for a dual overhead cam engine. However it will be appreciated that other configurations are possible without departing from the scope of this disclosure.

Each cam lobe may be coupled to camshaft 181 or camshaft 183. For example, the cam lobes coupled to camshaft 181 may actuate a corresponding intake valve, and further, the cam lobes coupled to camshaft 183 may actuate a corresponding exhaust valve. As shown, two intake cam lobes coupled to camshaft 181 and two exhaust cam lobes coupled to camshaft 183 may coincide with each cylinder 30.

Further, a plurality of shaft covers 134 may be positioned on either side of a set of cam lobes corresponding to a cylinder. In other words, each shaft cover may be positioned on either side of each cylinder, wherein each cylinder side is orthogonal to the shaft direction. It will be appreciated that the shaft covers may provide a housing vertically above valve train 130. Further, it is to be understood that the shaft covers may be attached to an engine block and/or cylinder head. Further still, it is to be understood that shaft covers 132 are not coupled to a dynamic component. For example, shaft covers 132 are not coupled to camshaft 181 or camshaft 183.

As introduced above, traditional engine drive systems are directly coupled to both camshafts. Due to size constraints, it is not possible to couple both camshafts to the engine drive system and achieve the compact arrangement of the present disclosure. For example, since the camshaft sprockets are traditionally twice the diameter of the crankshaft sprocket to ensure proper timing and actuation of the intake and exhaust valves with the combustion cycle, it is not possible to position two camshafts with the compact spacing of the present disclosure.

As such, the inventors herein have recognized that coupling a meshed gear drive to the engine drive system such that the axes of the camshafts are horizontally aligned, allows one camshaft to be indirectly driven by the engine drive system and another camshaft to be directly driven by the engine drive system. As such, a more compact valve train can be achieved due to the resulting geometric configuration. Thus, a more compact engine can be achieved with the disclosed engine drive system and meshed gear configuration.

Further, by reducing the spacing between the camshafts, a valve angle with a cylinder head port can be improved. As referred to herein, the valve angle is a contact angle between the intake valve and the piston as well as the exhaust valve and the piston. Therefore, by reducing the spacing between the camshafts, the intake and exhaust valves are positioned more vertical with respect to a cylinder head deck surface than traditional configurations, thereby improving the contact angle. Since a range of authority of a VCT actuator is limited by the valve angle, the range of authority is also improved. In other words, the range of authority of the VCT actuator can be increased without relying on the piston to contact the valves, if desired.

Further still, this configuration allows for improved variable cam timing mechanisms since the camshafts are independently actuated through different systems. For example, the exhaust camshaft (e.g., camshaft 183) may be phased directly by a VCT actuator, while the intake camshaft (e.g., camshaft 181) may be phased through the meshed gear drive.

It will be appreciated that engine drive system 100 is provided by way of example, and thus, is not meant to be limiting. Rather, engine drive system 100 is provided to illustrate a general concept, as various geometric configurations to couple a camshaft to a meshed gear drive are possible. Thus, it is to be understood that the engine drive system illustrated in FIGS. 1-3 may include additional and/or alternative features than those depicted without departing from the scope of this disclosure.

For example, in some embodiments the first and second gears may be rotatably coupled via a chain, a belt, or another coupling device. Thus it will be appreciated that first and second gears may not include teeth. In such an example, the first and second gears may have a smooth surface that engages a belt, although it is to be understood that such a belt would be another belt, in addition to belt 190. As another example, the first and second gears may have a groove that engages the belt.

As another example, the intake camshaft may be directly coupled to the engine drive system and the exhaust camshaft may be indirectly coupled to the engine drive system via the meshed gear drive. Other configurations are possible without departing from the scope of this disclosure.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine comprising:

a timing band rotatably coupling a first camshaft, a driveshaft and a crankshaft; and a gear drive including a first gear coupled to the driveshaft and a second gear coupled to a second camshaft, the second camshaft positioned between the first camshaft and the driveshaft and horizontally coplanar with the first camshaft and the driveshaft.

2. The system of claim 1, wherein the first camshaft is an exhaust camshaft and the second camshaft is an intake camshaft.

3. The system of claim 1, wherein the gear drive is a meshed gear drive such that the first gear matingly fits with the second gear.

4. The system of claim 1, wherein the gear drive is positioned behind a plurality of sprockets engaged by the timing band in a shaft direction.

5. The system of claim 4, wherein the first gear is positioned behind a sprocket coupled to the driveshaft in the shaft direction.

6. The system of claim 5, wherein the second gear is positioned behind the plurality of sprockets in the shaft direction and equidistant from the driveshaft and the first camshaft in a horizontal direction.

7. The system of claim 6, wherein a spacing between the first camshaft and the second camshaft is smaller than a distance between the first camshaft and the driveshaft in the horizontal direction.

8. The system of claim 7, wherein the second camshaft is offset from the first camshaft in the shaft direction.

9. The system of claim 1, wherein the first camshaft and the second camshaft include a plurality of cam lobes configured for a dual overhead cam engine.

10. The system of claim 1, wherein the timing band further engages one or more of the group consisting of a tensioning device, a chain guide, an idling device, and a pulley.

11. The system of claim 1, wherein the timing band synchronizes a rotation of the first camshaft, the driveshaft and the crankshaft in a first direction, and the first gear matingly fits with the second gear such that the second gear is driven to rotate in a second direction, opposite the first direction.

12. A system for an engine, comprising:

an engine drive system including a timing band rotatably coupling a first camshaft, a driveshaft and a crankshaft in a first direction;

a drive gear rotatively coupled to the driveshaft, and a driven gear meshed with the drive gear to drive a rotation of a second camshaft in a second direction opposite the first direction, the first and second camshafts and the driveshaft being horizontally coplanar.

13. The system of claim 12, wherein the drive gear and the driven gear are positioned behind the timing band in a shaft direction.

14. The system of claim 13, wherein the driven gear is positioned between the first camshaft and the driveshaft such that the driven gear is equidistant from the first camshaft and the driveshaft in a horizontal direction.

15. The system of claim 12, wherein the second camshaft is offset from the first camshaft in a shaft direction.

16. The system of claim 12, wherein a spacing between the first camshaft and the second camshaft is smaller than a distance between the first camshaft and the driveshaft in a horizontal direction.

17. A system for an engine comprising:

a first camshaft;

a crankshaft;

a timing band directly rotatively coupling the first camshaft and the crankshaft;

a second camshaft; and a meshed gear drive indirectly rotatively coupling the second camshaft to a sprocket engaged with the timing band, the second camshaft horizontally coplanar with the first camshaft and offset from the first camshaft in a shaft direction.

18. The system of claim 17, wherein the first camshaft is an exhaust camshaft and the second camshaft is an intake camshaft.

19. The system of claim 17, wherein the meshed gear drive includes a first gear coupled to the sprocket via a driveshaft, the first gear meshed with a second gear coupled to the second camshaft.

20. The system of claim 19, wherein a spacing between the first camshaft and the second camshaft is smaller than a distance between the first camshaft and the driveshaft in a horizontal direction.

* * * * *